US008679281B2

(12) United States Patent
Kalwara

(10) Patent No.: US 8,679,281 B2
(45) Date of Patent: Mar. 25, 2014

(54) METHOD OF MAKING A BUILDING MATERIAL HAVING A SELVAGE EDGE

(75) Inventor: Joseph J. Kalwara, Indianapolis, IN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 153 days.

(21) Appl. No.: 13/048,162

(22) Filed: Mar. 15, 2011

(65) Prior Publication Data

US 2011/0162791 A1 Jul. 7, 2011

Related U.S. Application Data

(63) Continuation of application No. 11/642,200, filed on Dec. 20, 2006, now Pat. No. 7,927,451.

(60) Provisional application No. 60/753,014, filed on Dec. 21, 2005.

(51) Int. Cl.

| | |
|---|---|
| ***E04F 13/072*** | (2006.01) |
| ***E04F 13/09*** | (2006.01) |
| ***E04F 13/21*** | (2006.01) |
| ***B29C 65/54*** | (2006.01) |
| ***B32B 37/12*** | (2006.01) |
| ***B32B 37/14*** | (2006.01) |
| ***B32B 38/04*** | (2006.01) |
| *E04B 2/44* | (2006.01) |

(52) U.S. Cl.
USPC ..... 156/259; 156/71; 156/250

(58) Field of Classification Search
USPC ..... 156/71, 247, 250–268, 290, 297
See application file for complete search history.

(56) References Cited

U.S. PATENT DOCUMENTS

| | | | | |
|---|---|---|---|---|
| 4,421,807 | A | 12/1983 | Clausing et al. | |
| 4,588,466 | A | 5/1986 | Eaton | |
| 4,767,658 | A | 8/1988 | Lorenz | |
| 4,925,515 | A | 5/1990 | Yoshimura et al. | |
| 5,322,724 | A | 6/1994 | Levens | |
| 5,440,855 | A | 8/1995 | Loucks | |
| 5,501,754 | A | 3/1996 | Hiraguri | |
| 5,593,771 | A | 1/1997 | Lawless et al. | |
| 5,595,618 | A * | 1/1997 | Fries et al. | 156/164 |
| 5,643,399 | A | 7/1997 | Venable | |
| 5,705,002 | A | 1/1998 | Sherry | |
| 5,839,250 | A | 11/1998 | Hibler | |
| 5,859,114 | A | 1/1999 | Davis et al. | |

(Continued)

FOREIGN PATENT DOCUMENTS

WO WO 2004070108 A2 8/2004

*Primary Examiner* — Sonya Mazumdar
(74) *Attorney, Agent, or Firm* — Jason A. Houser; Arthur M. Reginelli

(57) ABSTRACT

A method of forming a building material with a pre-applied adhesive, the method comprising the steps of manipulating a first membrane and a second membrane to be spaced from one another along parallel adjacent edges to form a gap; securing a single strip of adhesive tape to a top surface of both said first and second membranes adjacent to said adjacent edges so that said adhesive tape extends over said gap; and cutting along the length of said adhesive tape to form a first adhesive tape and a second adhesive tape, said first adhesive tape being secured to the top surface of said first membrane and extending over a portion of said gap, and said second adhesive tape being secured to the top surface of said second membrane and extending over a portion of said gap.

20 Claims, 7 Drawing Sheets

(56) References Cited

U.S. PATENT DOCUMENTS

| | | | | |
|---|---|---|---|---|
| 5,916,654 | A | 6/1999 | Phillips et al. | |
| 6,080,458 | A | 6/2000 | Russell et al. | |
| 6,217,692 | B1 * | 4/2001 | Kling | 156/229 |
| 6,413,606 | B1 | 7/2002 | Calderon | |
| 6,426,129 | B1 | 7/2002 | Kalwara et al. | |
| 6,901,711 | B2 * | 6/2005 | Fay et al. | 52/407.3 |
| 6,920,730 | B2 | 7/2005 | Becker et al. | |
| 6,938,386 | B2 | 9/2005 | Ritland et al. | |
| 7,045,750 | B2 * | 5/2006 | Holzer et al. | 219/634 |
| 7,175,732 | B2 | 2/2007 | Robison et al. | |
| 7,178,306 | B2 | 2/2007 | Fritz | |
| 7,550,187 | B2 | 6/2009 | Seth et al. | |
| 7,927,451 | B2 | 4/2011 | Kalwara | |
| 2004/0188008 | A1 | 9/2004 | Robison et al. | |
| 2005/0066621 | A1 | 3/2005 | Fritz | |

* cited by examiner

METHOD OF MAKING A BUILDING MATERIAL HAVING A SELVAGE EDGE

This application is a continuation of U.S. Non Provisional application Ser. No. 11/642,200, filed Dec. 20, 2006 now U.S. Pat. No. 7,927,451, which claims the benefit of U.S. Provisional Application 60/753,014, filed Dec. 21, 2005, both of which are incorporated herein by reference.

FIELD OF THE INVENTION

One or more embodiments are directed toward a method for preparing a roofing membrane carrying a solid adhesive strip positioned to form a tape selvage edge.

BACKGROUND OF THE INVENTION

Large, flexible sheets or membranes are often used in the construction industry as roofing material. These sheets are typically delivered to a construction site in a bundled roll, transferred to the roof, and then unrolled and laid flat. The sheets are then affixed to the building structure by employing varying techniques such as mechanical fastening, ballasting, and/or adhering the membrane to the roof deck or insulation layer. In order to achieve the necessary water repellent properties, the sheets are positioned so that the edges of adjoining sheets overlap. These overlapping portions are secured to one another through a number of methods depending upon the membrane materials and exterior conditions. One approach involves providing adhesives between the overlapping portions and applying pressure to the site, thereby creating a water resistant seal.

Adhesives may be applied at the job site in the form of a tape or solid adhesive strip. This method, however, has drawbacks including the need to prime the area where the tape may be applied. Additionally, applying the tape at the job site can be labor intensive and imprecise. Further, construction debris and dirt can contaminate the tape or membrane, leading to flawed or unsatisfactory tape adhesion. To alleviate these problems and provide a more uniform adhesive application, manufacturers provide membrane with a pre-applied tape. In other words, the tape is applied prior to delivery of the membrane to the job site, often within a factory or other controlled environment where priming and cleaning can be performed more effectively, as well as uniform and standard application of the tape.

The ability to pre-apply or factory apply the tape in a uniform, precise manner is particularly advantageous when a tape selvage edge is desired. A tape selvage edge includes the portion of the adhesive tape that overlaps the membrane edge. In other words, the tape selvage edge extends beyond the edge of the membrane and provides additional adhesive to the sealed areas. Particularly, the tape selvage edge improves water resistance and joint stability in areas where more than two membranes converge in areas known as T-joints. This is accomplished because the additional overlapping tape provides a more gradual gradation to the seal and reduces the opening at the T-joints.

Because it has been found that pre-application of the tapes is desirous, it is additionally important to develop efficient methods of applying the tape prior to shipment to a construction site. Particularly, it is preferable to apply tape to more than one membrane at a time, thereby increasing productivity. One such method entails providing a membrane and applying a tape along a central region of the membrane. The membrane and tape is then cut, thus producing two membranes, each of which having a tape on one side. While these construction methods may achieve greater production speeds and efficiency, some drawbacks remain. For example, cutting the membrane and tape after the tape has been applied results in a flush cut edge without a tape selvage. As a result, these methods do not enable a manufacturer to create the more desirable tape selvage edge.

Thus, because the tape selvage edge is desirable, there is a need for a production method that quickly and efficiently applies adhesive tapes to roofing membranes in a manner that can produce a tape selvage edge.

SUMMARY OF THE INVENTION

In one or more embodiments, the method of forming a building material according to the concepts of the present invention includes a method of forming a building material with a pre-applied adhesive, the method comprising the steps of manipulating a first membrane and a second membrane to be spaced from one another along parallel adjacent edges to form a gap; securing a single strip of adhesive tape to a top surface of both said first and second membranes adjacent to said adjacent edges so that said adhesive tape extends over said gap; and cutting along the length of said adhesive tape to form a first adhesive tape and a second adhesive tape, said first adhesive tape being secured to the top surface of said first membrane and extending over a portion of said gap, and said second adhesive tape being secured to the top surface of said second membrane and extending over a portion of said gap.

In one or more embodiments, the method of forming a building material according to the concepts of the present invention further includes a method of forming a building material with a pre-applied adhesive, the method comprising the steps of positioning a membrane; removing a strip of said membrane to separate said membrane into first and second membranes having parallel adjacent edges spaced from one another, thereby forming a gap between said adjacent edges; securing an adhesive tape to a top surface of both the first and second membranes so that said adhesive tape extends over said gap; and cutting along the length of the adhesive tape.

In one or more embodiments, the method of forming a building material according to the concepts of the present invention further includes a method of forming a building material with a pre-applied adhesive, the method comprising the steps of creating a gap between parallel adjacent edges of first and second membranes positioned on a cutting grid having a groove; securing an adhesive tape to a top surface of both said first and second membranes using a tape applicator device, the adhesive tape extending over said gap; and cutting said adhesive tape along the length of the adhesive tape with a cutting device having a guide mechanism, thereby forming a first adhesive tape and a second adhesive tape, wherein said gap between said first and second membranes is substantially aligned with said groove in said cutting grid, said guide mechanism engaging said groove to guide said cutting device.

DETAILED DESCRIPTION OF ILLUSTRATIVE EMBODIMENTS

A roofing membrane carrying an adhesive may be prepared by applying an adhesive along an edge of the membrane. In one or more embodiments, a solid adhesive may be applied along an edge of the membrane in a manner that produces a tape selvage edge. In these or other embodiments, two adhesive tapes are simultaneously applied to edges of two distinct membranes, respectively. In these or other embodiments, the two adhesive tapes that are simultaneously applied may be carried by a single release liner.

The membranes to which the adhesive is applied may include thermoset and thermoplastic membranes, including those that are conventional in the art. For example, thermoplastic membranes may include those including polyvinylchloride resins or polyolefin resins. Exemplary thermoset membranes include those including ethylene-propylene rubber, ethylene-propylene-diene rubber, or crosslinked derivatives thereof. Several thermoset membranes are known in the art such as those disclosed in U.S. Pat. Nos. 6,502,360, 6,044,604, 5,854,327, 5,735,092, 5,700,538, 5,468,550, 5,130,355, which are incorporated herein by reference. In one or more embodiments, the membranes may be characterized by ASTM-D-4637.

Figure 1:
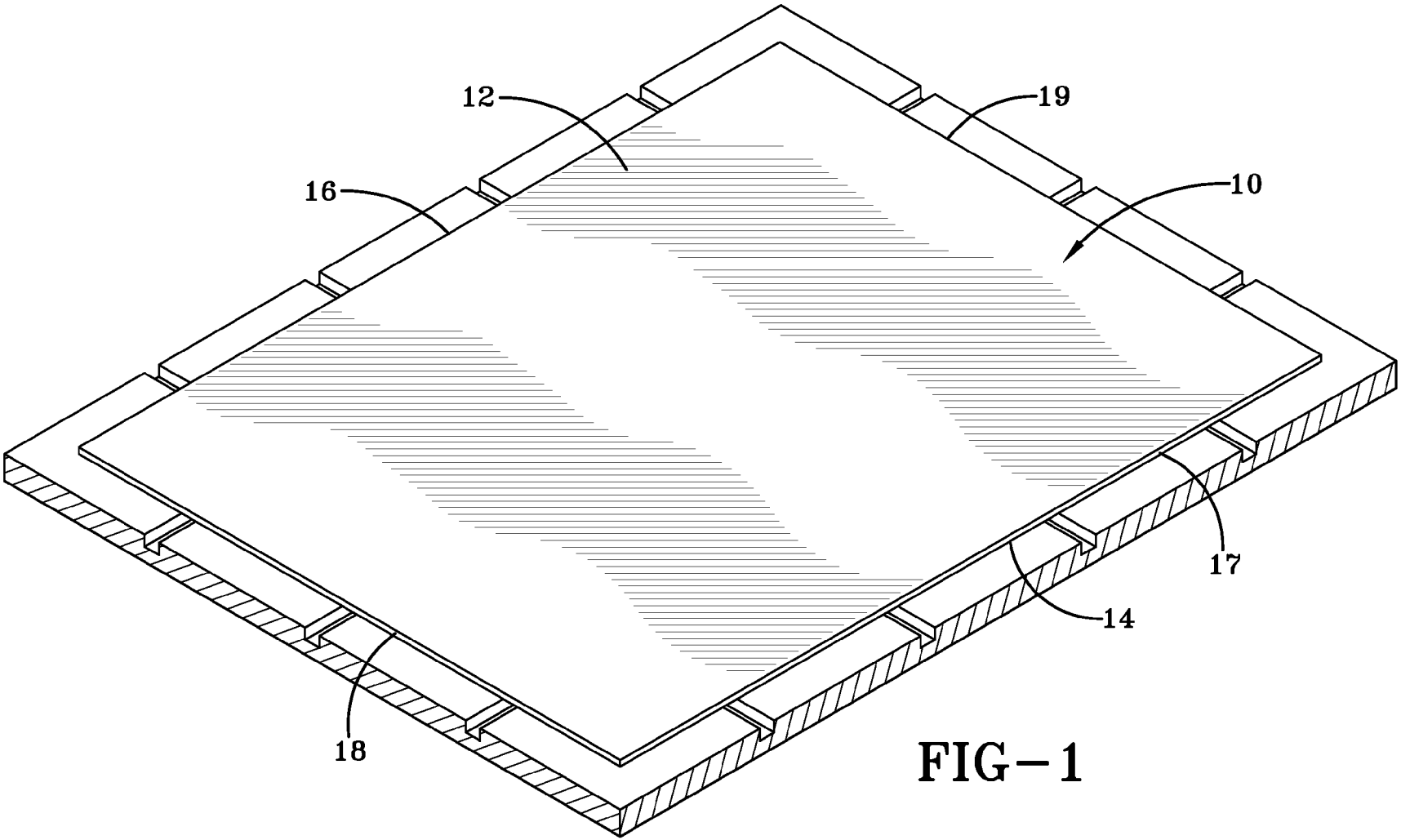
FIG. 1 is perspective view of the membrane and cutting area of the present invention.

An example of a suitable membrane is shown in FIG. 1, wherein a membrane 10 may be provided in the form of a generally rectangular sheet, which includes a top surface 12 and an opposed bottom surface 14. Top and bottom surfaces 12 and 14 terminate at a pair of opposed lateral edges 16 and 17 and a pair of opposed transverse edges 18 and 19. Lateral edges 16 and 17 meet transverse edges 18 and 19 to define an outer peripheral edge of membrane 10.

In one or more embodiments, two membranes are positioned within the same planar orientation prior to application of the solid adhesive. In one or more embodiments, this includes positioning an edge of one membrane proximate to or near an edge of a second membrane in a manner that provides a gap between the edges of the membranes. In one or more embodiments, the gap is from about ½ to about 2 inches. In other embodiments, the gap is from about ⅝ to about 1½ inches. In still other embodiments the gap is from about ¾ to about ⅞ inches. In these or other embodiments, the gap between the edges of the membranes does not vary by more than ¼", and in other embodiments by not more than ⅛" along the length of the edges that are proximate or near to one another.

The positioning of the membranes may be accomplished by employing several methods. In some embodiments, two separate membranes are positioned in the desired configuration. In other embodiments, a single membrane is cut into two membranes, and the resulting two membranes are separated to create the desired gap therebetween. In yet other embodiments, a single membrane is divided into two membranes by cutting a strip or ribbon from the membrane, thereby resulting in two membranes having the desired gap therebetween. In one or more embodiments, the gap is achieved without moving the membrane For example, with reference to FIG. 2, a pair of membranes 10*a* and 10*b* may be provided and positioned within the same planar orientation with a gap therebetween. The desired gap between the membranes can be achieved and/or maintained by the use of spacing devices or guides, which may be secured to the floor on which the membranes are supported. For example, first membrane 10*a* and a second membrane 10*b* may be manually oriented on a cutting area 20 whereby they can be separated by a gap 38. In one or more embodiments, first membrane 10*a* may include an edge 34 and the second membrane 10*b* includes an edge 36, where edge 34 and edge 36 may be opposed and the distance between them defines gap 38.

In one or more embodiments, the two distinct membranes positioned proximate to each other and within the same planar orientation may be formed by dividing (i.e. cutting) a single membrane. The single membrane may be divided along a cut line to provide two distinct membranes each including a cut edge along the cut line. The gap between the membranes can be achieved by repositioning (e.g. pulling apart or separating the membranes) after dividing them.

Figure 2:
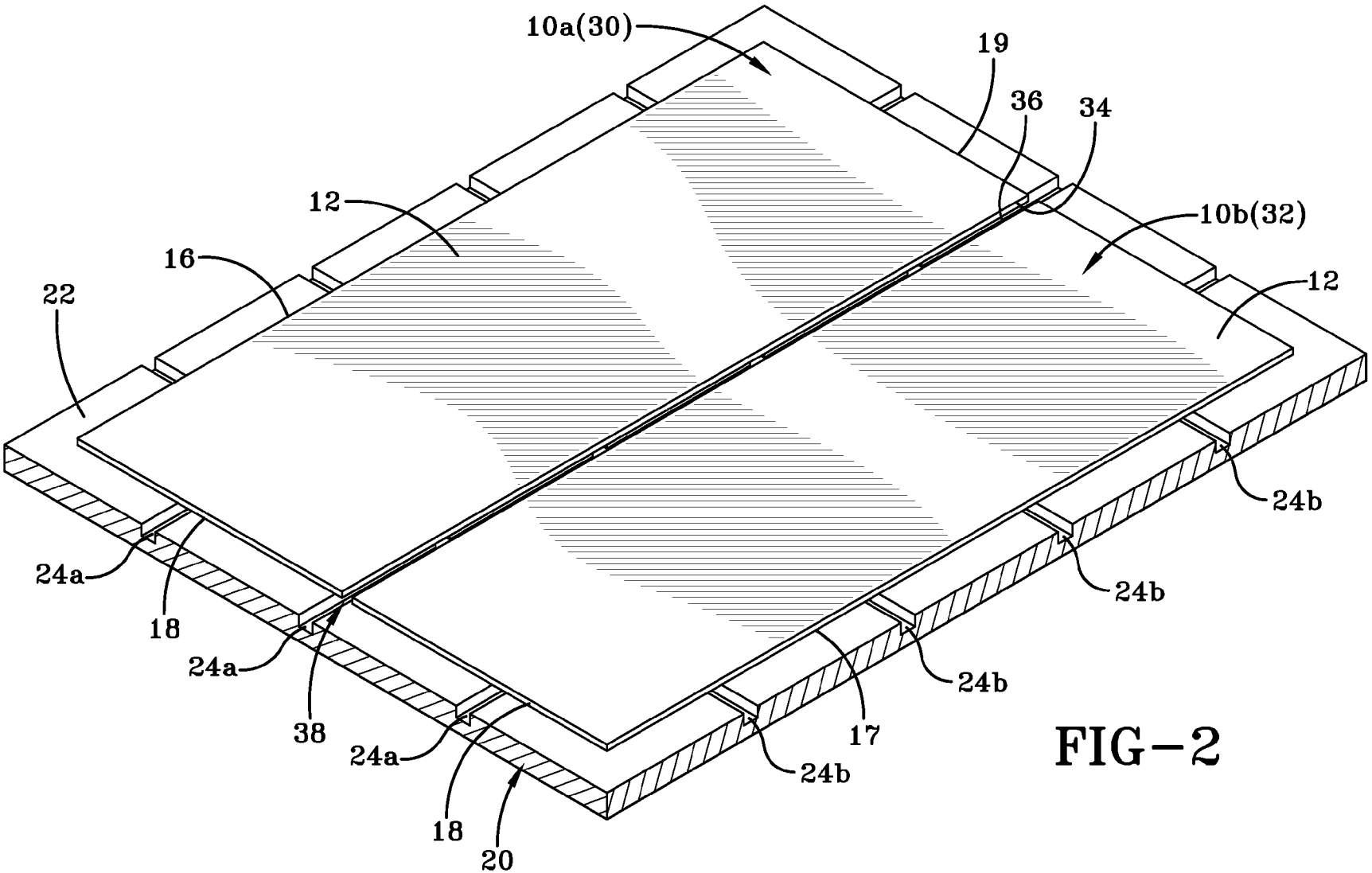
FIG. 2 is a perspective view of a pair of membranes positioned adjacent each other on the cutting area.

In one or more embodiments, the membrane may be divided by using a membrane-cutting grid. These grids include those that are known in the art such as those that exist in the floor of membrane-fabrication facilities or warehouses. For example, as shown in FIG. 2, membrane-cutting grid 20 may include planar surface 22 and at least one groove 24. Groove 24 may include a void or channel within planar surface 22. Groove 24 may have a substantially rectangular cross section.

In one or more embodiments, cutting area 20 may include a plurality of lateral grooves (e.g. 24*a*), which may be parallel and spaced by a predetermined distance. In one or more embodiments, the cutting area 20 may be provided with a plurality of transverse grooves (e.g. 24*b*), which can be parallel to one another and spaced by a predetermined distance. The transverse grooves may be disposed at an angle relative to the lateral grooves. In one embodiment, the transverse grooves may be disposed perpendicular to the lateral grooves. In this manner, a grid like array of grooves may be provided on cutting area 20.

Figure 6:
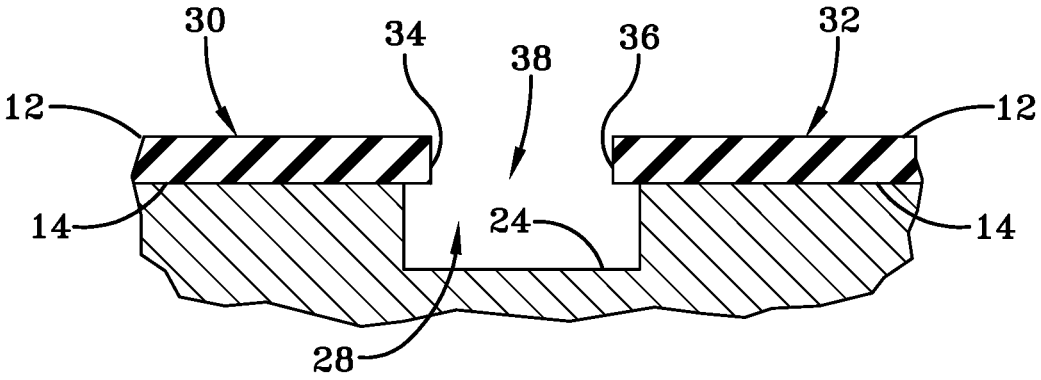
FIG. 6 is a sectional view taken substantially along line 6-6 of FIG. 3 showing first and second membrane portions with a gap therebetween.

Grooves 24 may facilitate cutting of the membrane 10. For example, when membrane 10 is disposed over groove 24, as shown in FIG. 6, a void 28 is provided that can allow a cutting member (not shown) to penetrate membrane 10 and extend below the bottom surface 14 into groove 24 and guide the same during the cutting operation. Groove 24 may receive a guide (not shown), such as a wheel or projection, that is adapted to ride within groove 24 and consequently guide the cutting member or any other machine over the membrane along a predetermined path defined by the groove 24.

Once properly positioned on cutting area 20, membrane 10 may be divided. Referring to FIG. 2, in one or more embodiments, the membrane 10 may be divided into a first portion 30 and a second portion 32. In one or more embodiments, the membrane 10 may be divided into first portion 30, which may also be referred to as first membrane 30, and second portion 32, which may also be referred to as second membrane 32, by employing a cutting device, which may include, for example, a reciprocating blade, a sharpened stationary blade, spinning blade or any other cutting tool known in the art. The membrane 10 may be cut along any profile, creating any final shape and size. As earlier discussed, it is generally preferable to cut membrane 10 along a line defined by groove 24. In one or more embodiments, the membrane 10 may be cut along a bisecting line and thereby create two equal sized portions. In other embodiments the membranes can be cut to provide different size membranes or panels. In any event, by cutting the membrane 10, new edges are formed. Consequently, after cutting, first portion 30 includes first cut edge 34, and second portion 32 includes second cut edge 36. Thus, first portion 30 includes a bottom surface 14 and top surface 12 that is bounded by a pair of opposed transverse edges 18 and 19, a lateral edge 16, and a first cut edge 34 substantially paralleling from the lateral edge 16. Likewise, second portion 32 includes a bottom surface 14 and a top surface 12 which is bounded by a pair of opposed transverse edges 18 and 19, a lateral edge 17 and a second cut edge 36 substantially paralleling the lateral edge 16.

Figure 3:
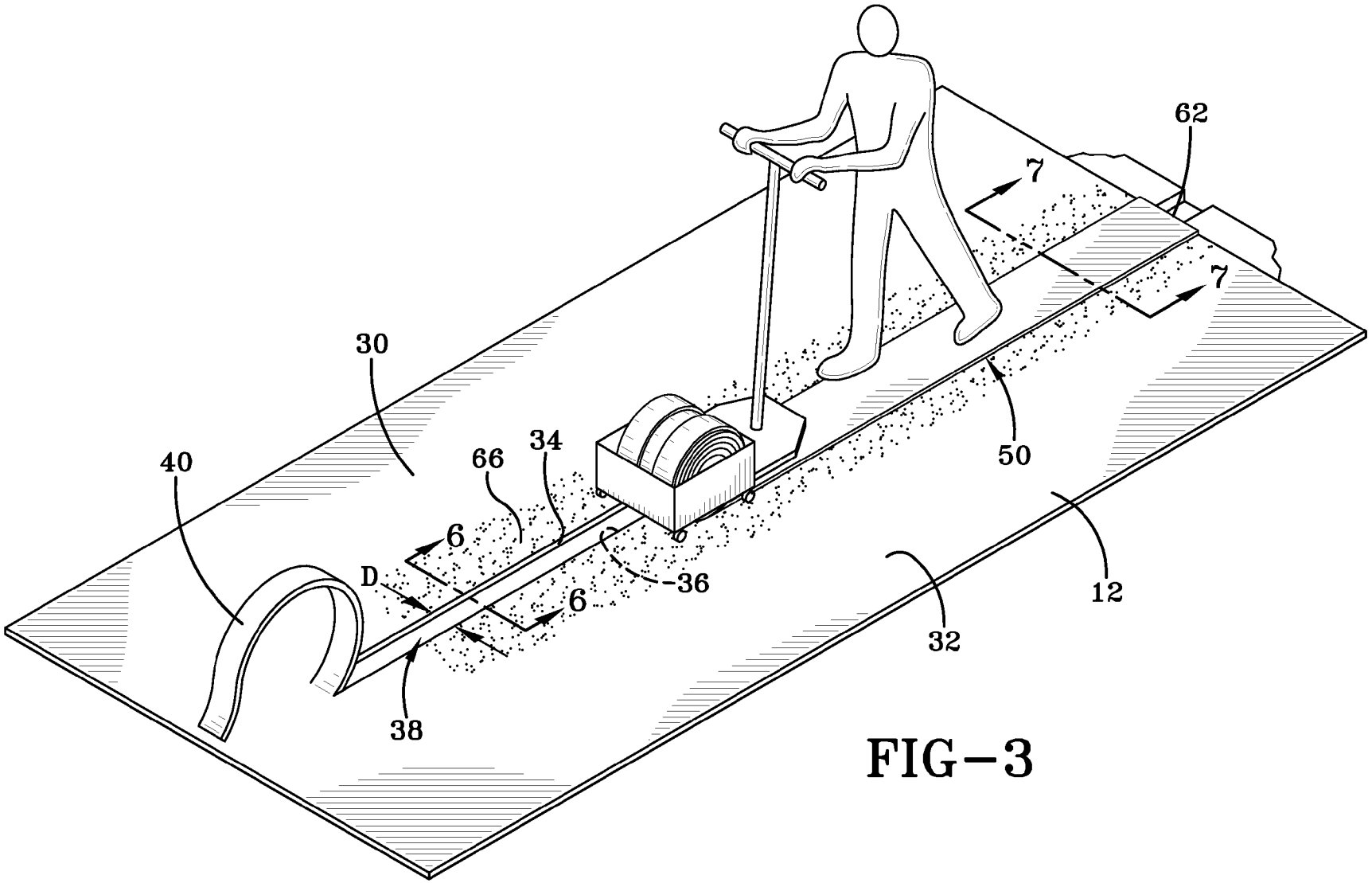
FIG. 3 is a perspective view of the membrane and an exemplary method of applying the tape assembly.

In one or more embodiments, as shown in FIG. 3, a strip 40, which may also be referred to as ribbon 40, may be removed from an interior portion of membrane 10. This may be accomplished by employing a pair of cutting members. In yet another embodiment, the strip 40 may be cut using a single, relatively thick cutting member. The resulting first and second portions 30 and 32 are thereby separated by the distance D corresponding to the width of strip 40. In other words, the step of dividing the membrane into two separate membranes simultaneously creates a desired gap D therebetween. In this manner, first and second portions 30 and 32 are spaced at a desired distance, and first and second cut edges 34 and 36 are created. The distance between first and second cut edges 34 and 36 define gap 38.

In one or more embodiments, it may be desirous to reduce the peripheral dimensions of the membrane 10 prior, during, or after the step of dividing the membrane. In such an instance, the grooves 24 may be positioned so that a pair of lateral grooves and a pair of transverse grooves form the desired peripheral shape. For example, FIG. 2 shows a pair of lateral grooves 24*a* and a pair of transverse grooves 24*b* which define a rectangular periphery. A membrane 10 may be provided over grooves 24*a* and 24*b*. The membrane 10 may then be cut along grooves 24 to provide a membrane with suitable peripheral dimensions and shape.

It should be appreciated that, although it is preferred to position a first and second membrane with a gap therebetween, one may place the membranes in an abutting relationship. This may be accomplished by cutting the membrane with a thin blade, or positioning two membranes next to one another. Thereafter, the tape assembly may be applied in the manner described herein below.

The solid adhesive, which may also be referred to as a solid adhesive strip or an adhesive tape, may include those that are conventional in the art. These may include those that include EPDM and/or butyl rubber. Useful adhesive tapes are disclosed in U.S. Pat. Nos. 6,120,869, 5,888,602, 5,859,114, 5,733,621, 5,612,141, 5,563,217, 5,545,685, 5,504,136, 4,932,171, 4,849,268, and 4,657,958, which are incorporated herein by reference. Useful tapes are commercially available including those available under the tradenames PLIO-SEAL™ (Ashland) or 510™ (Adco) or 505™ (Adco).

In one or more embodiments, the solid adhesive strip may be carried by a release liner. The release liner may include a thin film to which the adhesive strip may form a temporary bond with, but which bond can be readily broken by applying minimal tension. In one or more embodiments, the release liner may include a paper or cellulosic structure coated with a polymeric coating. In other embodiments, the release liner may include a homogeneous polymeric structure; for example, the release liner may include a polyester or polyolefin (e.g. polypropylene) film. The release liner may have different adhesion characteristics on each side, known as a differential release, which may be achieved by applying a different coating to each side. The differential release causes the adhesive tape to release from one side of the release liner before the other, which facilitates unrolling of the tape. The release liner may advantageously provide protection to the tape during storage or shipment, and remains in place until the actual mating of the tape to the adjacent membrane in the field.

Figure 4:
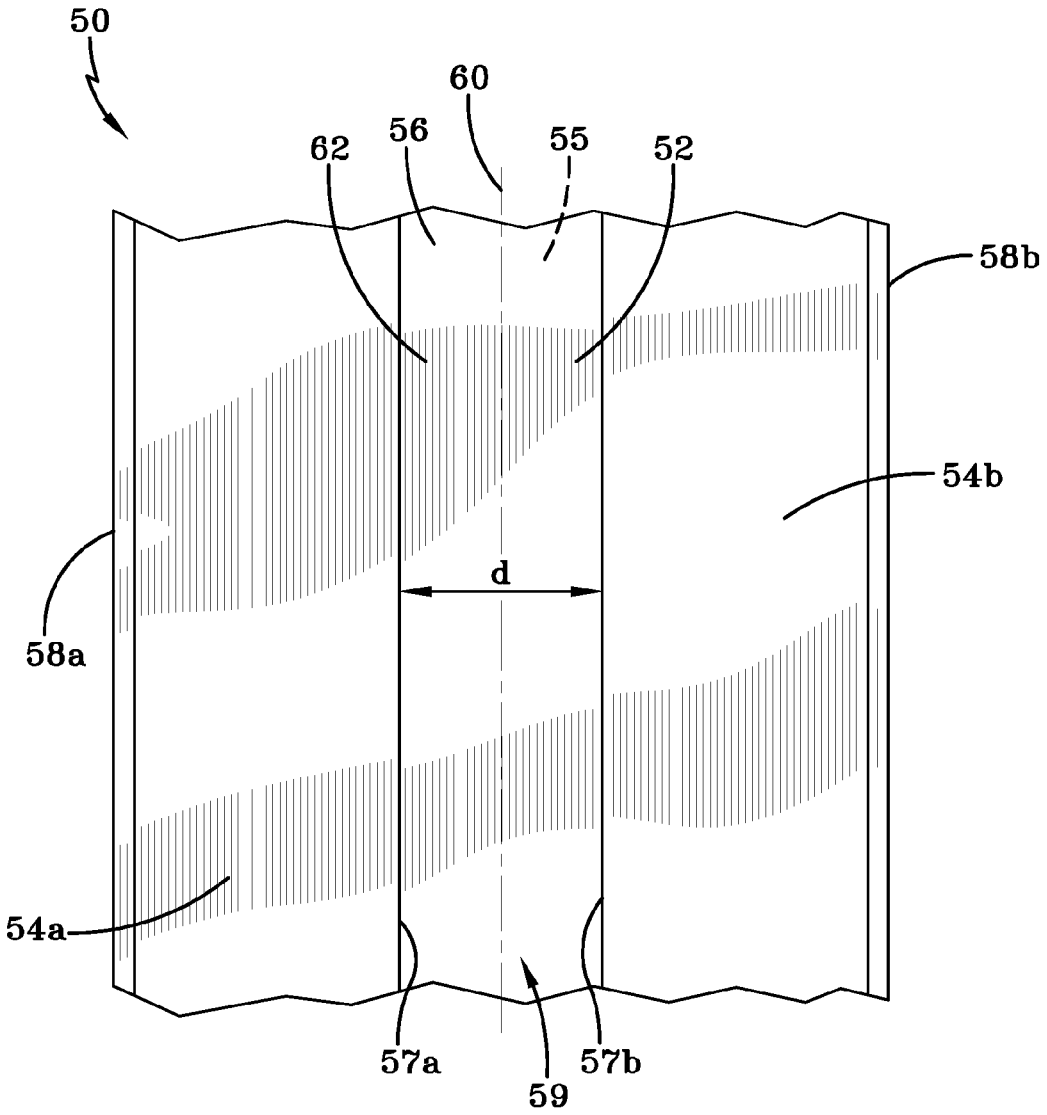
FIG. 4 is a fragmentary bottom view of the tape assembly of the present invention.

In one or more embodiments, a tape assembly, generally indicated by the numeral 50, is provided. As shown in FIG. 4, tape assembly 50 may include a release liner 52 and a pair of adhesive tapes 54*a* and 54*b*. Release liner 52 may include a top surface 55 and a spaced bottom surface 56, which terminate at spaced liner edges 58*a* and 58*b*. In one or more embodiments, a tape centerline 60 includes a line that is substantially parallel to liner edges 58*a* and 58*b* and corresponds to the middle of release liner 52. In other words, centerline 60 bisects tape along its length.

In one or more embodiments, a gap 59 exists between adhesive tape 54*a* and 54*b*. Specifically, gap 59 exists between adjacent edge 57*a* of tape 54*a* and adjacent edge 57*b* of tape 54*b*. The distance d between adjacent edge 57*a* and adjacent edge 57*b* may be from about ¼ to about 1¾ inches, in other embodiments from about ⅜ to about 1¼ inches, and in other embodiments from about ½ to about ⅝ inches.

In one or more embodiments, the pair of adhesive tapes 54*a* and 54*b* may be disposed on the bottom surface 56 of release liner 52. The release liner 52 carries the adhesive tapes 54, thus providing structural integrity while simultaneously protecting the adhesive tapes 54 from contaminants and unwanted adhesion prior to installation. The release liner additionally allows the tape to be rolled for storage and shipment. Further, adhesive tapes 54 may generally be described as elongated strips of adhesive material. The adhesive tapes 54 may be disposed along substantially the entire elongated length of release liner 52 in an orientation generally parallel with liner edges 58 and centerline 60. The adhesive tapes 54 are further disposed in a spaced relation to one another by a predetermined distance d. In one or more embodiments, the adhesive tapes 54*a* and 54*b* are disposed on opposed sides of centerline 60 and equidistant therefrom.

Figure 5:
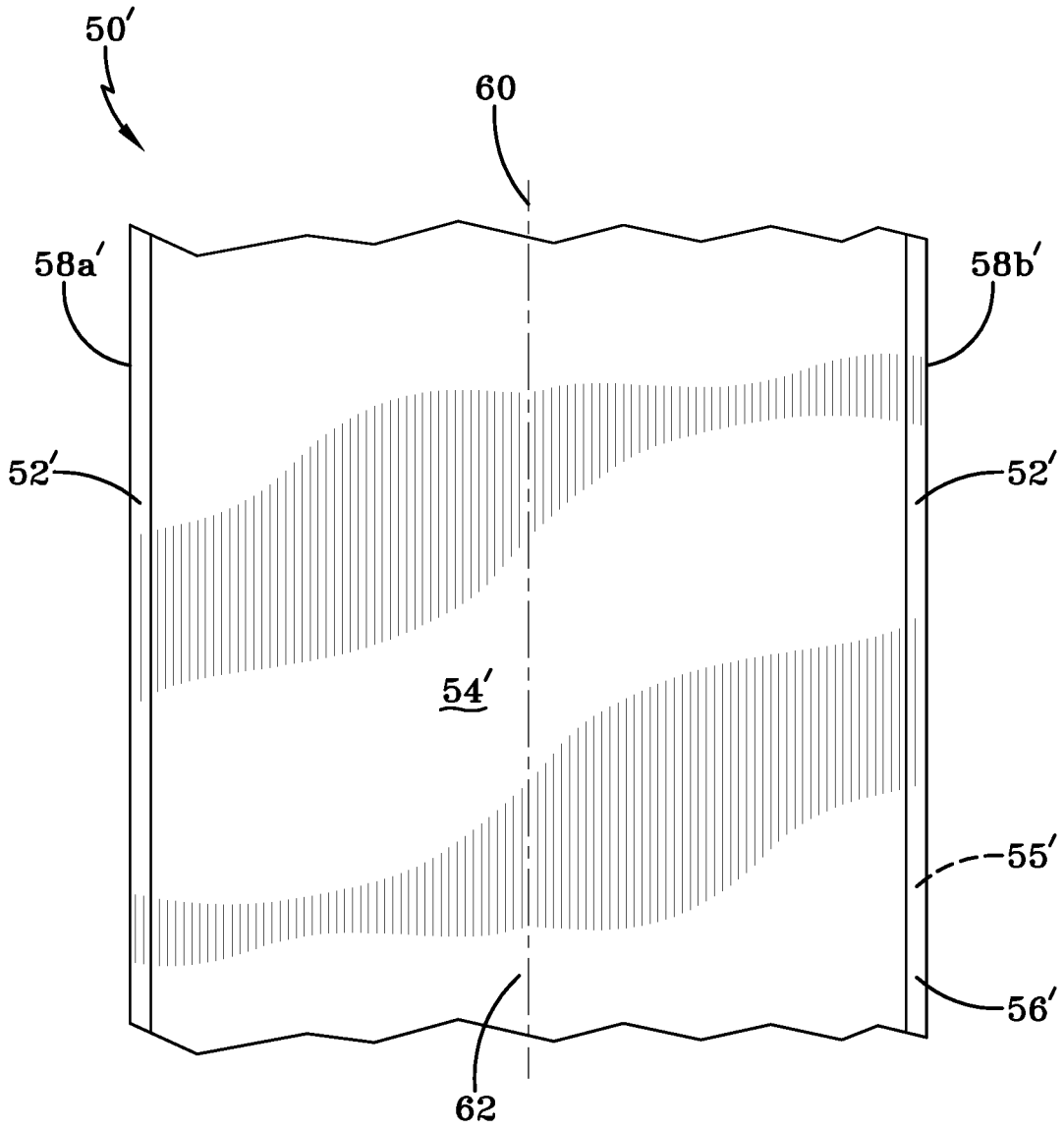
FIG. 5 is a fragmentary bottom view of an alternate tape assembly of the present invention.

In an alternate tape embodiment, shown in FIG. 5, a tape assembly 50' includes a release liner 52' and a single strip of adhesive tape 54'. Release liner 52' may include a top surface 55' and an opposed bottom surface 56', which terminate at opposed liner edges 58*a*' and 58*b*'. In one or more embodiments a tape centerline 60' includes a line that is substantially parallel to liner edges 58*a*' and 58*b*' and corresponds to the middle of release liner 52'. In other words, centerline 60' bisects tape assembly 50' along its length.

In one or more embodiments tape assemblies 50 or 50' may include a line of perforations 62 that enable easy tearing along that line. Perforations 62 may extend through the entire tape assembly 50/50' or only through release liner 52/52' or adhesive tape 54/54'. In one or more embodiments perforations 62 are located substantially along centerline 60.

In one or more embodiments, a primer 66 may be applied to the membrane 10 prior to application of the tape. Primer 66 may clean the surface and generally promotes a strong adhesive bond. Primer 66 may be applied to the top surface 12 of membrane 10 prior to tape application in any areas that will contact the adhesive tape 54. In one or more embodiments, the primer may be applied prior to dividing or cutting the membrane. In yet another embodiment, the primer may be applied after the membrane has been cut.

Figure 7:
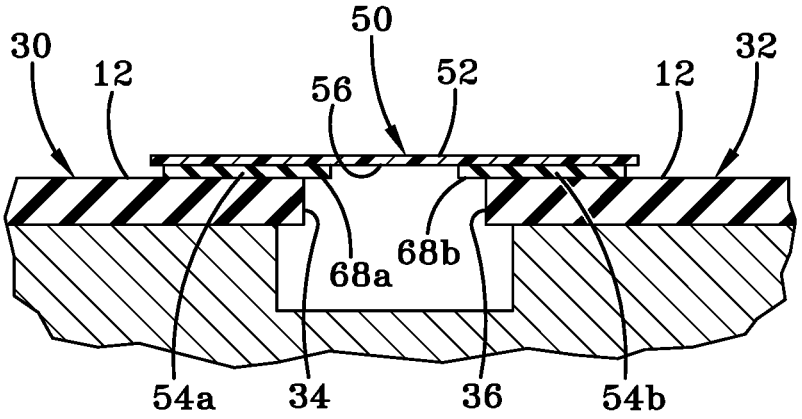
FIG. 7 is a sectional view taken substantially along line 7-7 of FIG. 3 showing the first and second membrane portions and the tape assembly applied over the gap.
Figure 8:
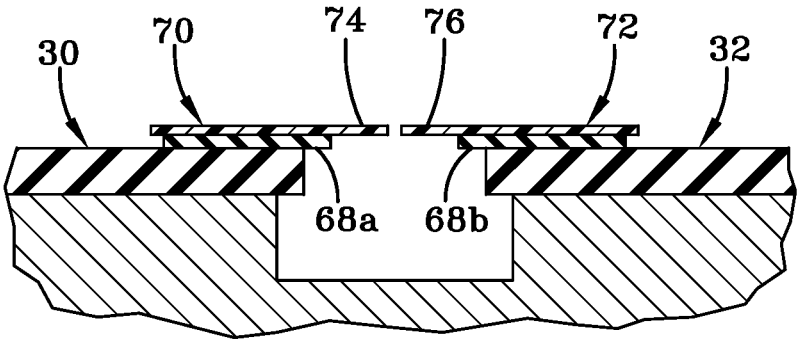
FIG. 8 is a sectional view of the first and second membrane portions with the tape assembly divided into a first and second tape assembly portion.

Once a pair of membrane portions have been positioned as discussed above, the adhesive tape may then be applied thereto. A shown in FIG. 7, tape assembly 50 may be positioned over gap 38 with the bottom surface 56 of release liner 52 facing top surface 12 of first and second portions 30 and 32. Tape assembly 50 may then be pressed against first and second portions 30 and 32 thereby applying adhesive tape 54*a* to first portion 30 and adhesive tape 54*b* to second portion 32. In one or more embodiments, the area of membrane 30 or membrane 32 to which the tapes may be applied may be referred to as tape receiving ledges or adjacent ledges.

In one embodiment, the centerline 60 of release liner 52 may be positioned substantially equidistant from first and second cut edges 34 and 36. The space d between the adhesive tapes 54 may be relatively smaller than the width D of gap 38. Thus, when applied correctly, an overhanging portion 68*a* and 68*b* or tape selvage edge of each adhesive strip 54 extends into gap 38. In one or more embodiments, the overhanging portion is from about 1/16" to about 5/16", and in other embodiments from about 3/16" to about 1/8". Thus, in this manner adhesive tape may be applied to each membrane portion simultaneously while also creating a tape selvage edge.

In one or more embodiments, tape assembly 50 may be provided in the form of a roll, as shown in FIG. 3. In such instances, tape assembly 50 may then be applied in a unrolling fashion along gap 38. Specifically, tape assembly 50 may be applied as described above to a first end of gap 38 (see FIG. 2). The tape assembly may then be applied over the length or distance of gap 38. In this manner, tape assembly 50 may be applied simultaneously to both first portion 30 and second portion 32, wherein first adhesive tape 54*a* adheres to top surface 12 of first portion 30 and second adhesive tape 54*b* adheres to top surface 12 of second portion 32. Further, the adhesive tapes 54*a* and 54*b* are disposed on first and second portions 30 and 32 so as to create an overlap portion 68*a* and 68*b*.

In one or more embodiments, the adhesive tapes (e.g. 54*a* and 54*b*) may be simultaneously applied from separate release liners. For example, two distinct tape rolls can be positioned on a single tape applicator and applied to the two membranes, respectively, from the single applicator. In one or more embodiments, the respective tapes may be positioned in the same or similar position with respect to the length of the membrane or edge thereof.

After application of the adhesive tapes to first and second portions 30 and 32, the release liner 52 may then be cut, thereby creating a first and second tape assembly portion 70 and 72. In one or more embodiments, the release liner may be cut generally down centerline 60. In other embodiments the release liner may be torn along perforations 62. In any event, the release liner may be cut at a location between adhesive tapes 54*a* and 54*b*. In this manner, a pair of membrane portions 30 and 32 may be provided that have a first and second tape assembly portion 70 and 72 disposed respectively along one edge. The membrane portions may then be rolled or otherwise prepared for shipment to a construction site.

To the extent that adhesive strip 54*a* and 54*b* include a gap therebetween, by cutting release liner 52 in the area of that gap can result in a release-liner selvage 74 and 76. These release-liner selvages may be advantageous because extra protection is achieved from contaminates, particularly along the edge of tape 54. The release liner also overhangs the opposed sides of adhesive strips 54*a* and 54*b*. Again, this overhanging edge provides added protection from contaminates and debris prior to installation.

Figure 9:
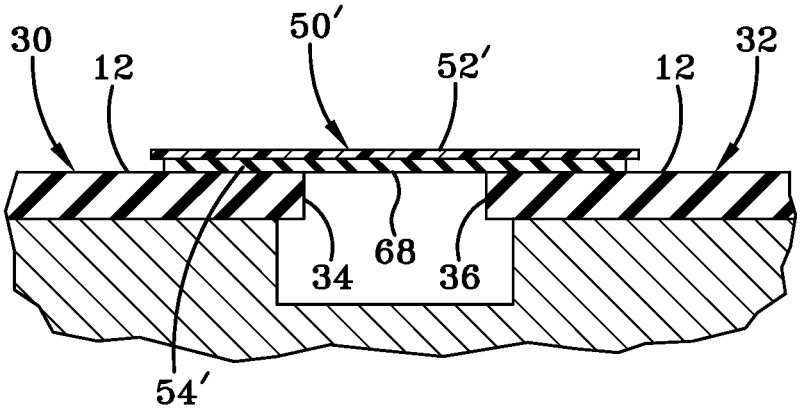
FIG. 9 is a sectional view of the first and second membranes with the alternate tape assembly applied thereto.
Figure 10:
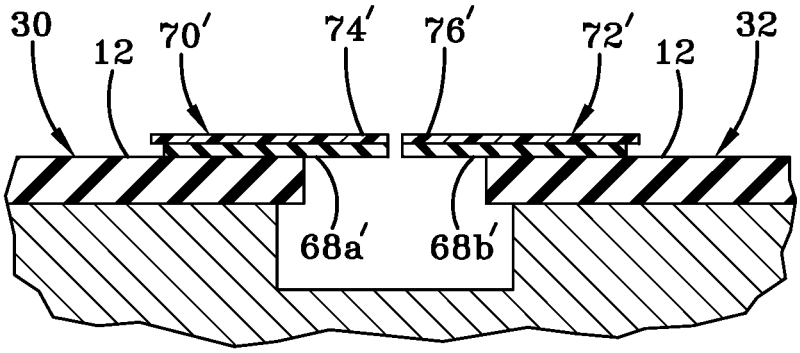
FIG. 10 is a sectional view of the first and second membrane with the alternate tape assembly with the tape assembly divided into a first and second tape assembly portion.

In an alternative embodiment, shown in FIG. 9, tape assembly 50' may be applied to first and second portions 30 and 32. Tape assembly 50' may be pressed against first and second portions 30 and 32 thereby applying adhesive tape 54' to first portion 30 and second portion 32 simultaneously. In one embodiment, the centerline 60' of release liner 52' may be positioned substantially equidistant from first and second cut edges 34 and 36.

After application of the adhesive tape 54' to first and second portions 30 and 32, the tape assembly 50' may then be cut, creating a first and second tape assembly portion 70' and 72'. In one or more embodiments, tape assembly 50' may be cut generally down centerline 60. In other embodiments, tape assembly 50' may be torn along perforations 62. In any event, tape assembly 50' may be cut so that a portion of tape 54' overhangs each section 30 and 32. In this manner, a pair of membrane portions 30 and 32 may be provided that have a first and second tape assembly portions 70' and 72' disposed respectively along one edge. The assembly portions 70' and 72' include overlap portions 68*a'* and 68*b'*.

In one or more embodiments, several of the aforementioned steps may be combined. For example, the step of cutting membrane 10 and the step of applying tape assembly 50 may be combined by using a machine that includes a cutting blade at the front leading edge and a tape applicator at the trailing edge. In yet another embodiment, a single machine may both apply and cut tape assembly 50. For example, the machine may include a tape applicator at the leading edge and a cutting means at the trailing edge. In yet another embodiment a single machine or apparatus may perform the steps of cutting a strip from membrane 10, applying tape assembly 50 and cutting tape assembly 50. In one or more embodiments, this machine may include a guide mechanism that can communicate with a groove within the assembly floor and/or the gap between the membranes. In one or more embodiments, the machine or apparatus may include a roller device that contacts the tape after application and applies pressure thereto so as to secure or set the tape to the membrane.

In one or more embodiments the manufacturing facility may include a laser guidance assembly. The laser guidance assembly may project a laser line onto the membrane surface to allow a worker to properly align the tape assembly. In still other embodiments a tape applying machine may include a contrast sensor adapted to view the dark edge of a tape assembly and a stepper motor to adjust the lateral position of the tape roll to maintain proper alignment during application. This may be necessary because variations may exist in the tape manufacturing process and thus the tape roll dimensions may vary.

Thus a method of quickly and efficiently applying a tape assembly to roofing membranes is disclosed. The methods of this invention improve upon the art because tape may be applied simultaneously to more than one membrane while also creating a tape selvage edge.

Various modifications and alterations that do not depart from the scope and spirit of this invention will become apparent to those skilled in the art. This invention is not to be unduly limited to the illustrative embodiments set forth herein.

What is claimed is:

1. A method of forming a building material with a pre-applied adhesive, the method comprising the steps of:

initially manipulating a first membrane and a second membrane to be spaced from one another along parallel adjacent edges to form a gap;

subsequently securing a single strip of adhesive tape to a top surface of both said first and second membranes adjacent to said adjacent edges so that said adhesive tape extends over said gap; and cutting along the length of said adhesive tape to form a first adhesive tape and a second adhesive tape, said first adhesive tape being secured to the top surface of said first membrane and extending over a portion of said gap, thereby forming a first selvage edge, and said second adhesive tape being secured to the top surface of said second membrane and extending over a portion of said gap, thereby forming a second selvage edge.

2. The method of claim 1, wherein said first and second membranes are thermoset membranes satisfying the requirements of ASTM-D-4637.

3. The method of claim 1, wherein said first and second membranes include cured ethylene-propylene-diene monomer rubber.

4. The method of claim 1, wherein a release liner is provided on a top surface of said adhesive tape.

5. The method of claim 1, wherein the adhesive tape includes a longitudinally extending centerline, said centerline being positioned approximately equidistant from said adjacent edges of said first and second membranes.

6. The method of claim 5, wherein the step of cutting includes cutting said adhesive tape approximately along said centerline.

7. The method of claim 1, wherein securing said adhesive tape and cutting said adhesive tape are performed simultaneously using a single device having a tape applicator adjacent to a leading edge and a cutting device adjacent to a trailing edge.

8. The method of claim 1, wherein manipulating said first and second membranes includes positioning said first and second membranes on a membrane cutting grid having at least one groove adapted to provide a guide for positioning of said first and second membranes.

9. A method of forming a building material with a pre-applied adhesive, the method comprising the steps of:

positioning a membrane;

removing a strip of said membrane to separate said membrane into first and second membranes having parallel adjacent edges spaced from one another, thereby forming a gap between said adjacent edges;

securing an adhesive tape to a top surface of both the first and second membranes so that said adhesive tape extends over said gap; and cutting along the length of the adhesive tape, thereby forming tape selvage edges on said first and second membranes that overhang a portion of said gap.

10. The method of claim 9, wherein the step of cutting along the length of the adhesive tape creates a first adhesive tape secured to said top surface of said first membrane and a second adhesive tape secured to said top surface of said second membrane, each of said first and second adhesive tapes extending over a portion of said gap to form a first selvage edge on said first membrane and a second selvage edge on said second membrane.

11. The method of claim 9, wherein the adhesive tape includes a release liner on one surface.

12. The method of claim 9, wherein the adhesive tape includes a longitudinally extending line, said line being positioned the same respective distance from said parallel adjacent edges.

13. The method of claim 12, wherein said adhesive tape is cut approximately along said line.

14. The method of claim 9, wherein the steps of securing said adhesive tape and cutting said adhesive tape are performed simultaneously using a single device having a tape applicator adjacent to a leading edge and a cutting device adjacent to a trailing edge.

15. The method of claim 9, wherein the steps of removing a strip of said membrane and securing an adhesive tape are performed simultaneously with a single device, the device having a cutting blade adjacent to a leading edge and a tape applicator adjacent to a trailing edge.

16. The method of claim 9, wherein the step of positioning said membrane includes positioning said membrane on a cutting grid having at least one groove adapted to provide a guide for positioning and cutting said membrane.

17. A method of forming a building material with a pre-applied adhesive, the method comprising the steps of:

initially creating a gap between parallel adjacent edges of first and second membranes positioned on a cutting grid having a groove;

subsequently securing an adhesive tape to a top surface of both said first and second membranes using a tape applicator device, the adhesive tape extending over said gap; and cutting said adhesive tape along the length of the adhesive tape with a cutting device having a guide mechanism, thereby forming a first adhesive tape and a second adhesive tape with tape selvage edges on said first and second membranes that overhang said gap, wherein said gap between said first and second membranes is substantially aligned with said groove in said cutting grid, said guide mechanism engaging said groove to guide said cutting device.

18. The method of claim 17, wherein said tape applicator device used to secure said tape includes a guide mechanism that engages said groove to guide said tape applicator device.

19. The method of claim 17, wherein the steps of securing said adhesive tape and cutting said adhesive tape are performed simultaneously with a single apparatus that includes said tape applicator device and said cutting device.

20. The method of claim 4, wherein a portion of said release liner overhangs said top surface of said adhesive tape to form a release liner selvage.

* * * * *